United States Patent [19]

Nomura et al.

[11] Patent Number: 4,462,366

[45] Date of Patent: Jul. 31, 1984

[54] AIR-FUEL RATIO CONTROL CIRCUIT FOR AN INTERNAL COMBUSTION ENGINE

[75] Inventors: Masaaki Nomura, Okazaki; Yukihiro Watanabe, Nagoya; Keiiti Yamamoto, Okazaki, all of Japan

[73] Assignee: Aisan Kogyo Kabushiki Kaisha, Obu, Japan

[21] Appl. No.: 475,506

[22] Filed: Mar. 15, 1983

[30] Foreign Application Priority Data

Mar. 29, 1982 [JP] Japan ..... 57-45105[U]

[51] Int. Cl.[3] ..... F02M 7/00; F02M 7/18

[52] U.S. Cl. ..... 123/440; 123/489

[58] Field of Search ..... 123/440, 489, 480

[56] References Cited

U.S. PATENT DOCUMENTS

| | | | |
|---|---|---|---|
| 4,345,562 | 8/1982 | Drews et al. | 123/489 |
| 4,363,306 | 12/1982 | Sone et al. | 123/440 |
| 4,380,985 | 4/1983 | Otsuka et al. | 123/440 |
| 4,393,841 | 7/1983 | Drews et al. | 123/440 |
| 4,399,790 | 8/1983 | Kataoka | 123/440 |
| 4,399,792 | 8/1983 | Otsaka et al. | 123/440 |
| 4,408,584 | 10/1983 | Tabuharu et al. | 123/440 |
| 4,411,236 | 10/1983 | Matsui et al. | 123/440 |
| 4,413,471 | 11/1983 | Hattori et al. | 123/440 |

*Primary Examiner*—Raymond A. Nelli

*Attorney, Agent, or Firm*—Dennison, Meserole, Pollack & Scheiner

[57] ABSTRACT

An air-fuel ratio control circuit for an internal combustion engine comprising a low-pass filter, a hysteresis type comparator, and delay timer, wherein output signals from an exhaust gas sensor are transmitted through the low-pass filter to the hysteresis type comparator and then to the delay timer. A pulse motor for controlling an air-fuel ratio is driven at high speeds for a specified period of time determined by the delay timer in either forward or reverse direction which is determined by the output of the comparator at each time when the output of the comparator is inverted and is driven at low speeds after the specified period of time has elapsed wherein the time constant of the low-pass filter is set longer than the delay time of the delay timer.

3 Claims, 9 Drawing Figures

AIR-FUEL RATIO CONTROL CIRCUIT FOR AN INTERNAL COMBUSTION ENGINE

BACKGROUND OF THE INVENTION

The present invention relates to an improvement of an air-fuel ratio control circuit for an internal combustion engine, and more particularly to measures against noises in an internal combustion engine which circuit is adapted for driving an air-fuel ratio control pulse motor under control in response to the output signal from an exhaust gas sensor, such as an $O_2$ sensor.

As the output signals from an $O_2$ sensor contain high frequency noises caused by the ignition and others, it has previously proposed to transmit the output through a low-pass filter LPF1 composed of a resistor R1 and a capacitor C1 to a comparator CM1 composed of resistors R2 and R3 and an operational amplifier OPA1, as is shown in FIG. 1. The waveform shown in FIG. 2A which contains a noise NA is transmitted from the sensor to the filter LPF1 from which the waveform shown in FIG. 2B is outputted, containing the noise waveform NB. When the reference voltage Vr of the comparator CM1 is set above the voltage of the noise waveform NB, for example at Vr1 indicated by the chain line in FIG. 2B, the original output waveforms PA2 and PA4, for example, in FIG. 2A are cut off together with the noise waveform NA, and the pulse duration of the output from the comparator CM1 becomes shorter than that from the sensor, and consequently the output from the comparator CM1 cannot correspond to that from the sensor. When the reference voltage Vr of the comparator CM1 is, however, set to Vr2 indicated by the solid line in FIG. 2B, almost no waveform of the output from the $O_2$ sensor is cut off, and disadvantageously the noise waveform NA in FIG. 2A will be also transmitted in the form of NC in FIG. 2C from the comparator CM1. The pulse durations of the output pulses PC1 to PC4 from the comparator are shorter than those of the output pulses PA1 to PA4 in FIG. 2A from the sensor, and consequently more or less the output from the comparator CM1 cannot precisely correspond to that from the sensor.

SUMMARY OF THE INVENTION

Accordingly, it is a primary object of the present invention to provide an air-fuel ratio control circuit for an internal combustion engine which remedies the above shortcoming of the prior art.

It is another object of the present invention to provide an air-fuel ratio control circuit for an internal combustion engine having a simple circuit configuration which serves to effectively eliminate the influence of the noise so as to drive an air-fuel ratio control pulse motor under the control precisely responsive to the output from an $O_2$ sensor.

In an air-fuel ratio control circuit for an internal combustion engine according to the present invention, the output signal from an exhaust gas sensor is transmitted through a low-pass filter to a hysteresis type comparator, and then to a delay timer. An air-fuel ratio control pulse motor is driven at high speeds for a specified period of time determined by the delay timer in either forward or reverse direction determined by the output of the comparator at each time when the output of the comparator is inverted, and is driven at low speeds after the specified period of time has elapsed. The time constant of the low-pass filter is set longer than the delay time of the delay timer.

The invention will become more fully apparent from the claim and the description as it proceeds in connection with the drawings.

DETAILED DESCRIPTION OF THE INVENTION

Figure 4:
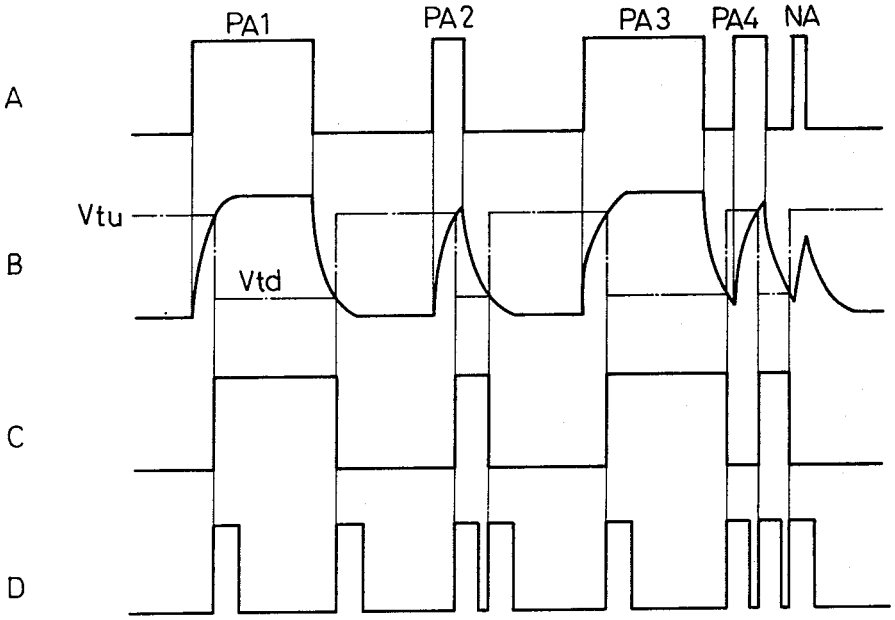
FIGS. 4A to 4D and FIGS. 5A to 5C are diagrams illustrating the operational characteristics of the circuit of FIG. 3.
Figure 3:
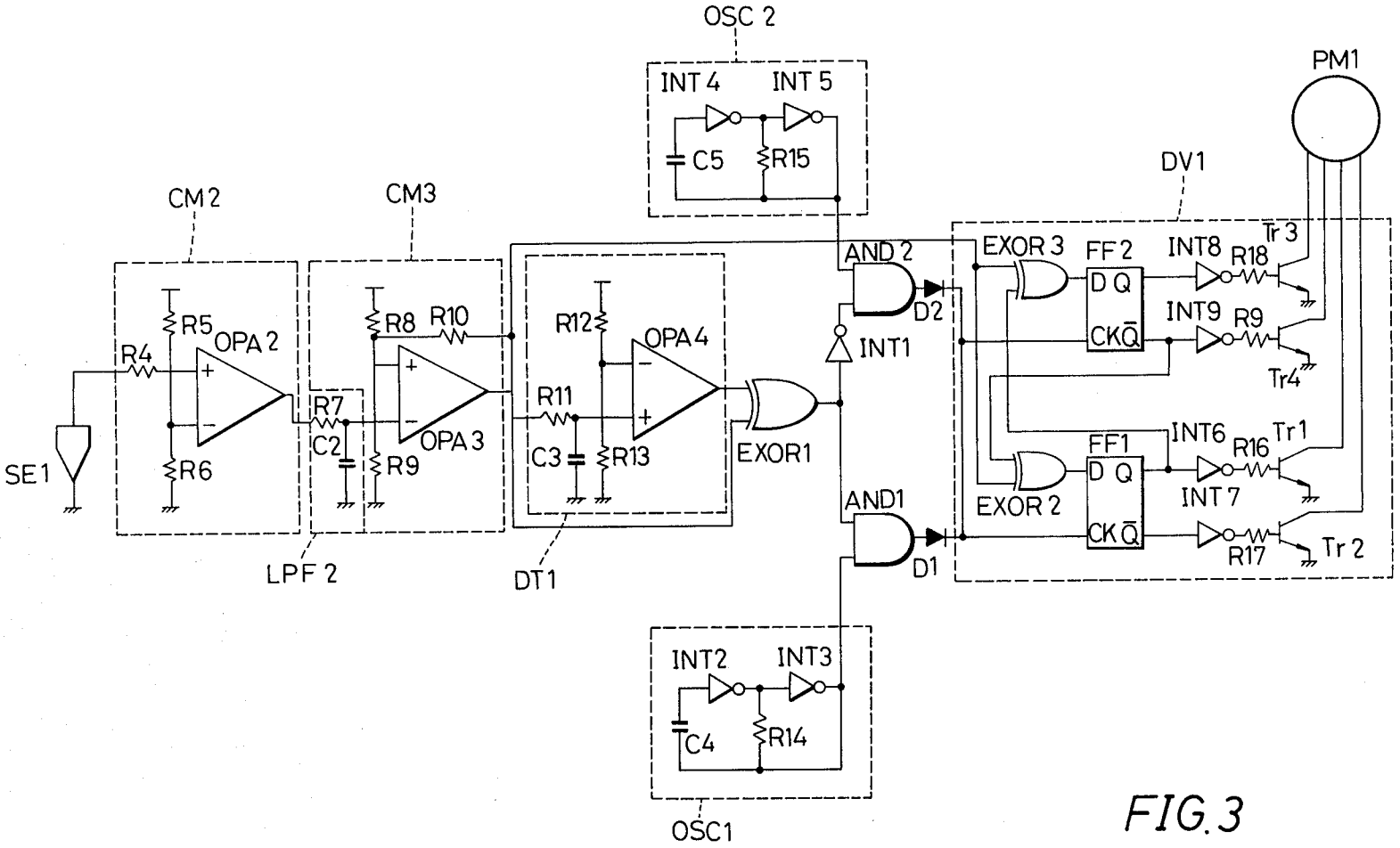
FIG. 3 is a circuit diagram of an embodiment of the invention.

Referring now to FIGS. 3 and 4, an $O_2$ sensor SE1 serves to output a signal corresponding to the richness and leanness in the air-fuel ratio. The output signal is transmitted to a comparator CM2 composed of resistors R4 to R6 and an operational amplifier OPA2, and then transmitted through a low-pass filter LPF2 composed of a resistor R7 and a capacitor C2 to a hysteresis type comparator CM3 composed of resistors R8 to R10 and an operational amplifier OPA2, and then transmitted through a low-pass filter LPF2 composed of a resistor R7 and a capacitor C2 to a hysteresis type comparator CM3 composed of resistors R8 to R10 and an operational amplifier OPA3. The waveform of the output signal from the $O_2$ sensor shown in FIG. 4A is changed into that of FIG. 4B, when it passes through the low-pass filter LPF2.

The reference voltage of the hysteresis type comparator CM3 is changed as is indicated by the chain line in FIG. 4B by inversion of the output of the comparator, and owing to the change of the reference voltage, the comparator CM3 outputs the pulses having the waveform shown in FIG. 4C (the drawing is inverted for easy comparison of the waveform change). The pulses are inputted to a delay timer DT1 composed of resistors R11 to R13, a capacitor C3 and an operational amplifier OPA4. An exclusive OR circuit EXOR1 receives the output signals from the delay timer DT1 and the comparator CM3, and outputs a pulse having the specific duration determined by the delay timer DT1 at every time when the pulse of the comparator CM3 rises and falls, as is shown in FIG. 4D. The output from the exclusive OR circuit EXOR1 is fed in two directions. The output in one direction where it does not pass through an inverter INT1 is transmitted to an input terminal of an AND circuit AND1, the other input terminal of the AND circuit AND1 being connected to an oscillator OSC1 which is composed of a resistor R14, a capacitor C4 and inverters INT2 and INT3 and adapted to generate clock pulses at a relatively short period in response to a high speed rotation of an air-fuel ratio control pulse motor PM1. The output of the exclusive OR circuit EXOR1 in the other direction is supplied through the inverter INT1 to an input terminal of an AND circuit AND2, the other input terminal of the AND circuit AND2 being connected to an oscillator OSC2 which is composed of a resistor R15, a capacitor C5 and inverters INT4 and INT5 and adapted to generate clock pulses at a relatively long period in response to a low speed rotation of the pulse motor PM1. The outputs of the AND circuits AND1 and AND2 are supplied through diodes D1 and D2, respectively, to the clock terminals CK of D-type flip-flops FF1 and FF2 which are the components of a circuit DV1 for driving the pulse motor PM1. The forward or reverse driving output signal for the pulse motor PM1 from the comparator CM3 as shown in FIG. 4C is also supplied through exclusive OR circuits EXOR2 and EXOR3, which are the components of the driving circuit DV1, to D terminals of the D-type flip-flops FF1 and FF2, respectively. The Q and $\overline{Q}$ outputs of each of the flip-flops FF1 and FF2 are supplied through inverters INT6 to INT9, resistors R16 to R19 and transistors Tr1 to Tr4, respectively, to each phase of the pulse motor PM1.

The air-fuel ratio control circuit for an internal combustion engine thus constructed functions as follows. The comparator CM2 outputs signals PA1 to PA4 corresponding to the richness and leanness in the air-fuel ratio which are detected by the $O_2$ sensor SE1 and a noise signal NA from the ignition and others, as is shown in FIG. 4A. The output of the comparator 2 is supplied through the low-pass filter LPF2, where the output is changed into the waveform shown in FIG. 4B, to the comparator CM3.

As the comparator CM3 is a hysteresis type circuit, the output of the comparator CM3 is inverted when the input waveform shown in FIG. 4B goes higher than the upside trip voltage Vtu of the comparator during the rise time of the input signal, and the output is inverted again when the input waveform in FIG. 4B goes lower than the downside trip voltage Vtd of the comparator CM3 during the fall time of the input signal.

The voltage, which is obtainable when the noise input signal NA having short pulse duration passes through the filter LPF2, does not reach the upside trip voltage Vtu of the comparator CM3. Thus, the comparator CM3 does not generate an output corresponding to the noise signal NA from the comparator CM2, and the output waveform of the comparator CM3 is inverted at each time when the input waveform during the rise time goes higher than the upside trip voltage Vtu and that during the fall time goes lower than the downside trip voltage Vtd with a substantially constant delay caused by the delay timer DT1. As a result, the comparator CM3 generates the outputs which closely follow only the output waveforms PA1 to PA4 of the comparator CM2, except the noise signal NA, produced by the $O_2$ sensor SE1, having almost the same pulse durations.

The output waveform thus produced by the comparator CM3 is inputted to the driving circuit DV1 as a forward or reverse driving signal for the pulse motor PM1. The exclusive OR circuit EXOR1, receiving the output waveform of the comparator CM3 and the delayed waveform from the delay timer DT1 (the inverted waveform as shown in FIG. 4C), outputs a pulse having a specified duration determined by the delay timer DT1 at every time when the output waveform of the comparator CM3 rises and falls, or when the rotational direction of the pulse motor PM1 is changed, as is shown in FIG. 4D. The pulse motor PM1 is, as is shown in FIG. 5A, driven at high speeds in response to the clock pulse from the oscillator OSC1 for a specified period of time determined by the pulse duration as shown in FIG. 4D and then at low speeds in response to the clock pulse from the oscillator OSC2 at each time when the waveform of the comparator CM3 is inverted to change the rotational direction of the pulse motor PM1.

Figure 5:
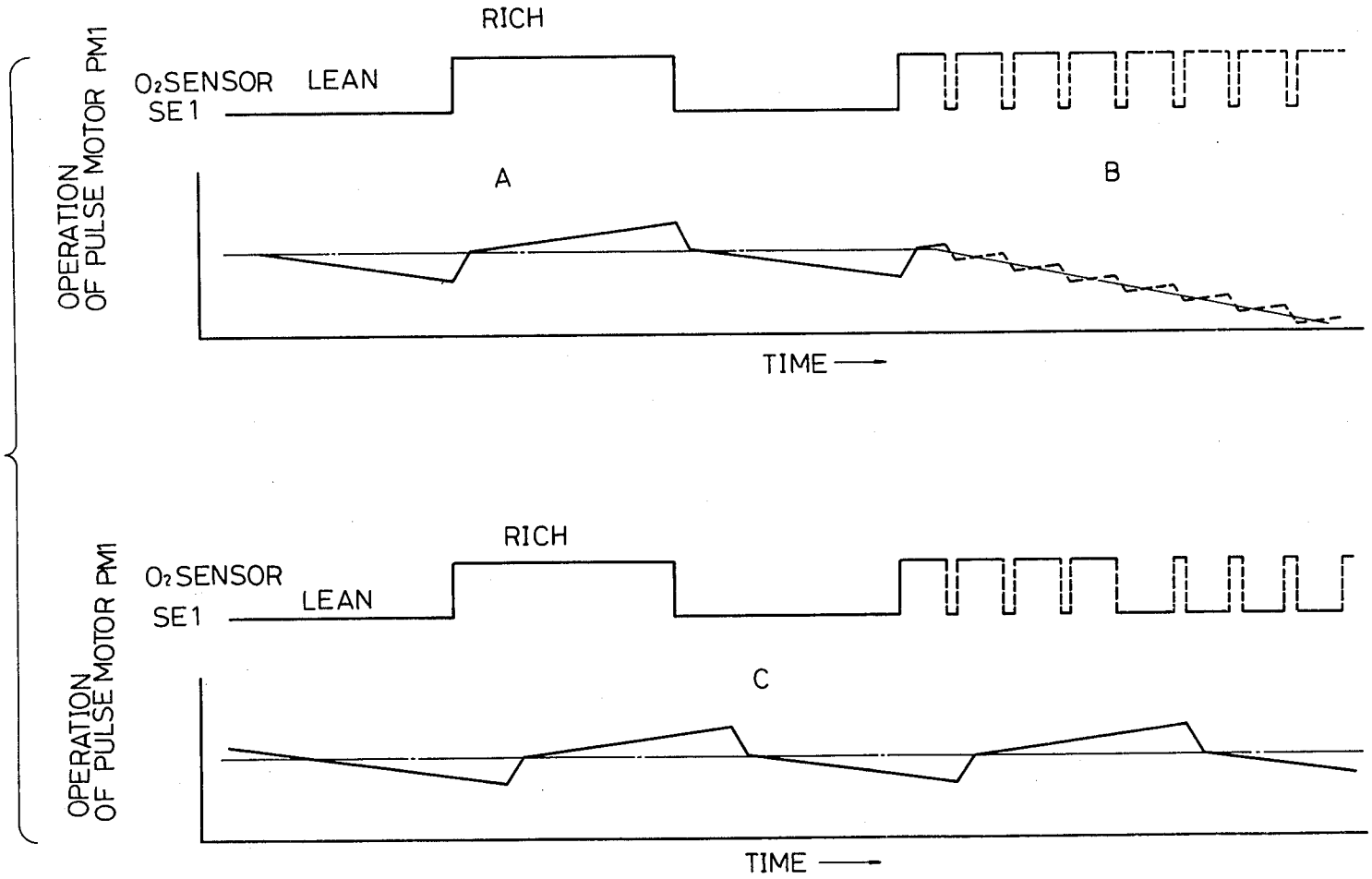

In the circuit shown in FIG. 3, when the time constant of the low-pass filter LPF2 is set shorter than the delay time of the delay timer DT1, the pulse duration in the rich state in the EXOR1 output fed to the pulse motor PM1 becomes asymmetrical to that in the lean state, and if the output waveform from the $O_2$ sensor SE1 is frequently inverted from the rich state to the lean state and vice versa due to increase in unburned gas in the engine or the influence of the noise, the operation of the pulse motor PM1, which is shown as an average by the chain line in FIG. 5, is depreciated as is shown in FIG. 5B and as the result, becomes incapable of proper air-fuel ratio control. In case the time constant is, however, set longer than the delay time of the delay timer DT1, the pulse motor PM1 is properly operated for air-fuel ratio control, as is shown in FIG. 5C, without being influenced by frequent inversion from the rich state to the lean state and vice versa. (In FIG. 5B, though the $O_2$ sensor generates a signal in the rich state, the noises indicated by the dotted line cause to operate the pulse motor in such a manner as to make the air-fuel ratio rich, and as the result, the $O_2$ sensor is kept in the rich state.)

Figure 1:
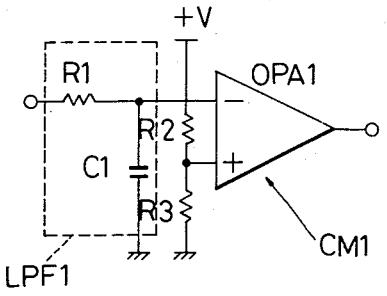
FIG. 1 is a fragmentary circuit diagram of a prior art.
Figure 6:
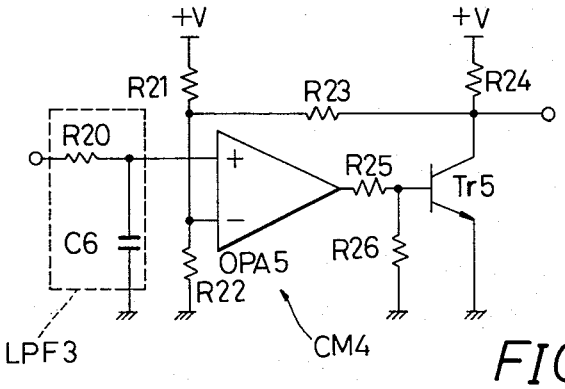
FIG. 6 is a fragmentary circuit diagram of another embodiment of the invention.
Figure 2:
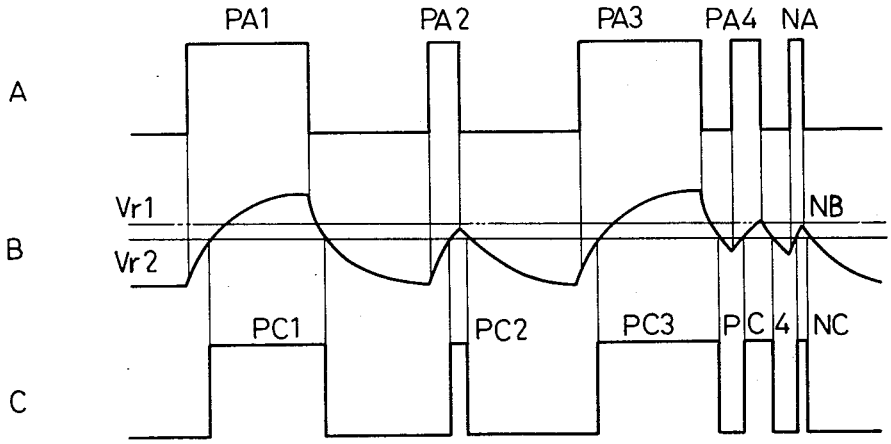
FIGS. 2A to 2C are waveform diagrams illustrating the operational characteristics of the prior art.

FIG. 6 illustrates a circuit according to another embodiment of the invention, which corresponds to the low-pass filter LPF2 and the hysteresis type comparator CM3 in FIG. 3. In this circuit, the output of an operational amplifier OPA5 is inverted through a transistor Tr5, and the input and output waveforms with respect to the circuit correspond to those shown in FIGS. 4A, 4B and 4C. With the exception of the above difference, the configuration, operation and effect are almost the same as those of the first embodiment.

While the invention has been described with reference to a few preferred embodiments thereof, it is to be understood that modifications or variations may be easily made without departing from the scope of the present invention which is defined by the appended claims.

What is claimed is:

1. An air-fuel ratio control circuit for an internal combustion engine comprising a low-pass filter; a hysteresis type comparator; a delay timer, output signals from an exhaust gas sensor being transmitted through said low-pass filter to said hysteresis type comparator and then to said delay timer; and a pulse motor for controlling air-fuel ratio of said internal combustion engine and adapted to be driven in either forward or reverse direction determined by the output of said comparator at high speeds for a specified period of time determined by said delay timer at each time when the output of said comparator is inverted wherein said pulse motor is driven at low speeds after the specified period of time has elapsed, and the time constant of said low-pass filter is set longer than the delay time of said delay timer.

2. The air-fuel ratio control circuit as defined in claim 1, wherein said hysteresis type comparator includes a resistor and an operational amplifier.

3. The air-fuel ratio control circuit as defined in claim 2, further comprising a transistor included in said hysteresis type comparator.

* * * * *